US011465263B2

(12) United States Patent
Woetzl et al.

(10) Patent No.: US 11,465,263 B2
(45) Date of Patent: Oct. 11, 2022

(54) CONTROL METHOD FOR AN IMPACT WRENCH

(71) Applicant: Hilti Aktiengesellschaft, Schaan (LI)

(72) Inventors: Christian Woetzl, Feldkirch (AT); Dario Bralla, Buchs (CH); Matthaeus Alberding, Rheineck (CH)

(73) Assignee: Hilti Aktiengesellschaft, Schaan (LI)

( * ) Notice: Subject to any disclaimer, the term of this patent is extended or adjusted under 35 U.S.C. 154(b) by 500 days.

(21) Appl. No.: 16/090,880

(22) PCT Filed: Mar. 29, 2017

(86) PCT No.: PCT/EP2017/057402
§ 371 (c)(1),
(2) Date: Oct. 3, 2018

(87) PCT Pub. No.: WO2017/174415
PCT Pub. Date: Oct. 12, 2017

(65) Prior Publication Data

US 2019/0118353 A1 Apr. 25, 2019

(30) Foreign Application Priority Data

Apr. 4, 2016 (EP) ..... 16163630

(51) Int. Cl.
*B25B 21/02* (2006.01)
*B25B 23/147* (2006.01)

(52) U.S. Cl.
CPC ..... *B25B 21/026* (2013.01); *B25B 21/02* (2013.01); *B25B 23/1475* (2013.01)

(58) Field of Classification Search
CPC .... B25B 21/026; B25B 21/02; B25B 23/1475
(Continued)

(56) References Cited

U.S. PATENT DOCUMENTS 5,457,866 A * 10/1995 Noda ..... B25B 21/026 29/407.02
6,546,815 B2 4/2003 Yamada et al.
(Continued)

FOREIGN PATENT DOCUMENTS

DE 69400774 T2 5/1997
DE 102007045695 A1 4/2009
(Continued)

*Primary Examiner* — Hemant Desai
*Assistant Examiner* — Mary C Hibbert-Copeland
(74) *Attorney, Agent, or Firm* — Davidson, Davidson & Kappel, LLC

(57) ABSTRACT

A control method includes two operating modes carried out in response to a position of a selector switch. The first operating mode provides: carrying out first impacts of the hammer onto the anvil; detecting the event of an impact of the hammer onto the anvil with an impact sensor; detecting an angular position of the anvil with an angle sensor; estimating an individual impact angle of the anvil due to the last detected impact, based on the angular position of the anvil before the last detected impact and the angular position of the anvil after the last detected impact, and comparing the individual impact angle with an individual impact setpoint angle. The first operating mode is ended when the individual impact angle drops below an individual impact setpoint angle. The second operating mode provides: detecting the angular position of the anvil with the angle sensor as the initial position; carrying out second impacts of the hammer onto the anvil; and detecting a relative rotation angle of the anvil with respect to the initial position during the second impacts. The second operating mode is ended when the relative rotation angle exceeds a standard angle.

14 Claims, 3 Drawing Sheets

(58) Field of Classification Search
USPC ..... 173/1
See application file for complete search history.

(56) References Cited

U.S. PATENT DOCUMENTS

| | | | |
|---|---|---|---|
| 9,089,956 | B2 | 7/2015 | Arimura et al. |
| 2012/0234566 | A1 | 9/2012 | Mashiko et al. |

FOREIGN PATENT DOCUMENTS

| | | | | |
|---|---|---|---|---|
| EP | 2873487 | A1 * | 5/2015 | ..... B60B 29/006 |
| EP | 2873487 | A1 | 5/2015 | |
| JP | 2012086284 | | 5/2012 | |

* cited by examiner

CONTROL METHOD FOR AN IMPACT WRENCH

The present invention relates to a control method for an impact wrench for fastening steel components with the aid of screw connections.

SUMMARY OF THE INVENTION

The present invention provides a control method that has two operating modes, which are carried out in response to a position of a selector switch. The first operating mode provides the following steps:

Carrying out first impacts of the hammer onto the anvil; detecting the event of an impact of the hammer onto the anvil with the aid of an impact sensor; detecting an angular position of the anvil with the aid of an angle sensor; estimating an individual impact angle of the anvil due to the last detected impact, based on the angular position of the anvil before the last detected impact and the angular position of the anvil after the last detected impact, and comparing the individual impact angle to an individual impact setpoint angle. The first operating mode is ended when the individual impact angle drops below an individual impact setpoint angle.

The second operating mode provides the following steps: Detecting the angular position of the anvil, with the aid of the angle sensor as the initial position; carrying out second impacts of the hammer onto the anvil; and detecting a relative rotation angle of the anvil with respect to the initial position during the second impacts. The second operating mode is ended when the relative rotation angle exceeds a standard angle.

The combined control methods are each in and of themselves not suitable for securely fastening steel components with the aid of an electromechanical impact wrench, using screwing elements, e.g. screws, bolts, nuts. However, the combination of the two methods makes it possible to reliably tighten the screw elements using the limited sensory means of an impact wrench.

One embodiment provides for detecting a rotational movement of the power tool housing during the second operating mode with the aid of a rotational movement sensor and determining the relative rotation angle, based on the angular position of the anvil and the rotational movement of the power tool housing. During the second operating phase, pivoting movements of the impact wrench are preferably taken into account by the user when determining the shutoff criterion.

One embodiment provides that a predefined number of third impacts of the hammer are carried out during the first operating mode after dropping below the individual impact setpoint angle. If a selected screw connection requires very small individual impact setpoint angles, the method may be approximately ended at a higher individual impact setpoint angle and supplemented by a fixed number N of impacts.

One embodiment provides for checking whether a screw connection is to be tightened with the aid of the second operating method regardless of the switch position of the operating mode selector switch. Before carrying out the second impacts, at least one first impact may be carried out, the individual impact angle in relation to the first impact determined and compared to the individual impact setpoint angle. If the individual impact angle exceeds the individual impact setpoint angle, the second operating mode is aborted.

The screw connection and possibly adjacent screw connections are not yet properly tightened with the aid of the first operating mode.

The setting of the screw connections may individually log the first operating mode and the second operating mode for each screw.

BRIEF DESCRIPTION OF THE DRAWINGS

The following description explains the present invention based on exemplary specific embodiments and figures. In the figures.

Unless otherwise indicated, identical or functionally equivalent elements are identified by identical reference numerals in the figures.

DETAILED DESCRIPTION

Figure 1:
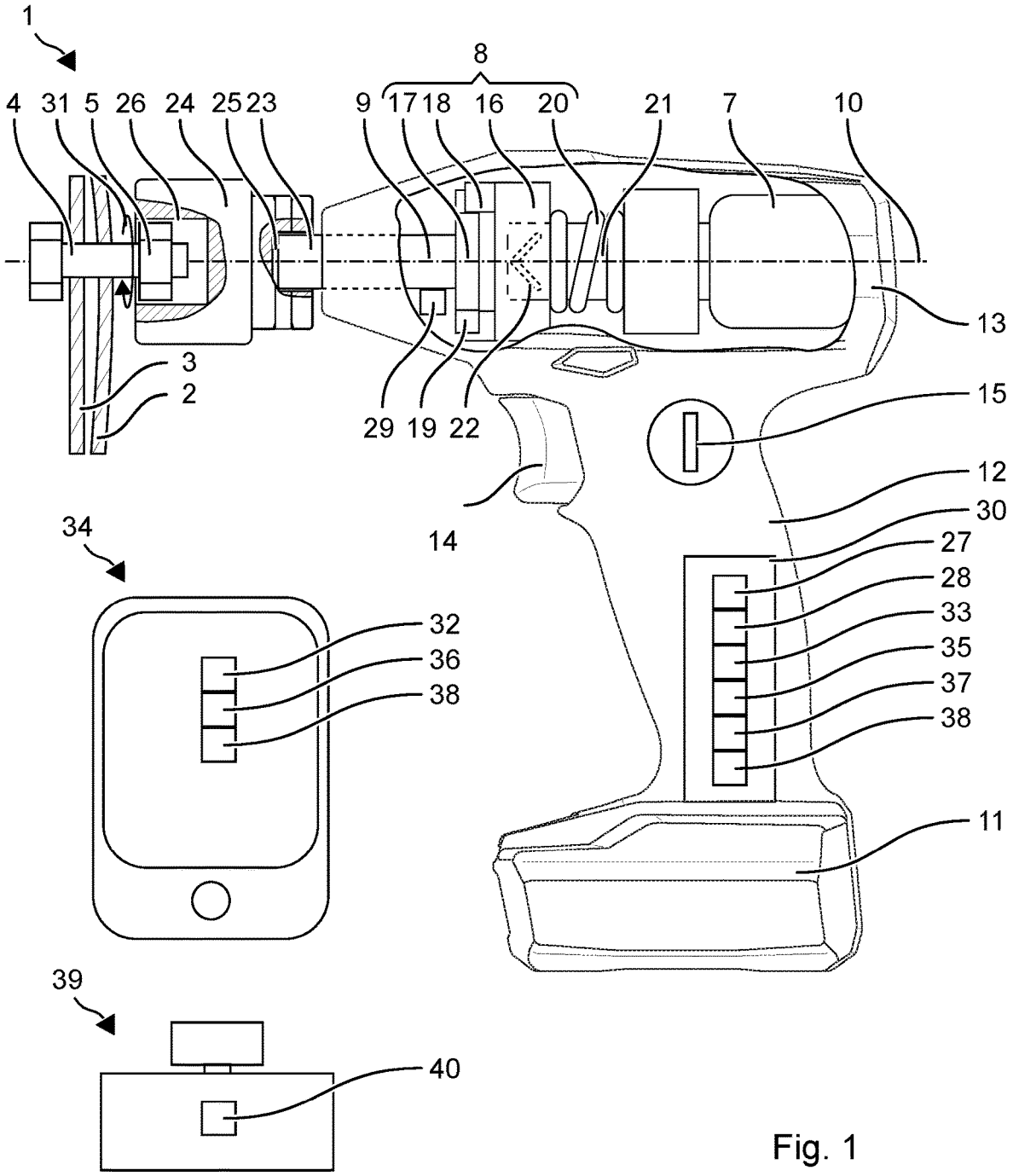
FIG. 1 shows an impact wrench.

FIG. 1 schematically shows the configuration of an impact wrench 1. One application of impact wrench 1 is to screw a steel plate 2 to a steel beam 3. Steel plate 2 and steel beam 3 are connected to each other by a screw 4 and a nut 5. Typical steel plates and steel beams have undefinedly domed surfaces, which apply a counter-force similar to a steel spring when screwed together. Impact wrench 1 supports the user in a secure screwing action. The steel plate should planarly abut the steel beam, and screw 4 should not be overexpanded.

Screw 4 or nut 5 is tightened in two phases. The screw head of screw 4 is advantageously fixed and nut 5 is tightened.

In the first phase, nut 5 is tightened until screw 4 is expanded to approximately 40% to 60% of its yield strength. The expansion is not measured directly but estimated with the aid of an individual impact angle theta, around which nut 5 rotates due to a single impact. It is recognized that, for the targeted range of the yield strength, i.e. 40% to 60%, individual impact angle theta is largely dependent only on screw 4 and nut 5 and only to a limited degree on unknown stresses of steel beam 3 and steel plate 2. Corresponding to individual impact angle theta, an upper limit (individual impact setpoint angle Theta) is determined in test series for each screw type, i.e. as a function of diameter, length, thread pitch, material pairing of screw 4 and nut 5, etc. It may be advantageous to establish individual impact setpoint angle Theta as a function of the total thickness of steel beam 3 and steel plate 2. In the first phase, nut 5 continues to be tightened until individual impact angle theta drops below individual impact setpoint angle Theta during a single impact. If multiple screws are needed to fix steel plate 2, this first phase is carried out for all of their nuts.

In a subsequent second phase, nut 5 continues to be tightened until screw 4 is expanded to approximately 70% to 80% of its yield strength. The expansion is not measured directly but estimated with the aid of a relative rotation angle dphi of nut 5 with respect to screw 4. It was recognized that this expansion may no longer be determined with sufficient accuracy with the aid of individual impact angle theta. The a priori unknown influences, e.g. dispersive coefficients of friction, individual properties of steel plate 2, etc., dominate the dependency of individual impact angle theta on the expansion. However, it was likewise recognized that, starting at the expansion already reached by the first phase, relative rotation angle dphi is a robust measure of the expansion. Corresponding to relative rotation angle dphi, an upper limit (standard angle dPhi) is determined in test series for each screw type, i.e. as a function of diameter, length, thread pitch, material pairing of screw 4 and nut 5, etc. It may be advantageous to establish standard angle dPhi as a function of the total thickness of steel beam 3 and steel plate 2. The relative rotation angle is determined starting at the beginning of the second phase, e.g. it is reset to zero at the beginning of the second phase. Nut 5 is tightened by rotating it around standard angle dPhi.

The step-by-step tightening of screw 4 has proven to be tolerant to different tensionings between steel plate 2 and steel beam 3. A possible overexpansion of screw 4 due to a single-stage tightening up to a predefined torque may be avoided hereby.

Impact wrench 1 has an electric motor 7, a striking mechanism 8 and an output spindle 9. Striking mechanism 8 is driven continuously by electric motor 7. If a retroactive torque M of output spindle 9 drops below a load value MO, striking mechanism 8 periodically strikes output spindle 9 at a brief, but very high torque. Correspondingly, output spindle 9 initially rotates continuously and then step-by-step around a working axis 10. Electric motor 7 may be powered via a battery 11 or be mains-operated.

Impact wrench 1 includes a handle 12, with the aid of which the user may hold and guide impact wrench 1 during operation. Handle 12 may be fastened to a power tool housing 13 rigidly or with the aid of damping elements. Electric motor 7 and striking mechanism 8 are situated in power tool housing 13. Electric motor 7 may be switched on and off with the aid of a pushbutton 14. Pushbutton 14 is situated, for example, directly on handle 12 and may be actuated with the hand surrounding the handle. Impact wrench 1 includes an operating mode selector switch 15 for switching between a first operating mode and a second operating mode.

The example of striking mechanism 8 includes a hammer 16 and an anvil 17. Hammer 16 includes dogs 18, which abut dogs 19 of anvil 17 in the rotation direction. Hammer 16 is able to transmit a continuous torque or brief angular momentums to anvil 17 via dogs 18. A helical spring 20 pretensions hammer 16 in the direction of anvil 17, whereby hammer 16 is held in engagement with anvil 17. If the torque exceeds the threshold value, hammer 16 shifts against the force of helical spring 20 until dogs 18 are no longer engaged with anvil 17. Electric motor 7 may accelerate hammer 16 in the rotation direction until hammer 16 is forced to re-engage with anvil 17 with the aid of helical spring 20. Hammer 16 transmits the temporarily obtained kinetic energy onto anvil 17 in a short pulse. One embodiment provides that hammer 16 is forcibly guided along a spiral path 22 on a drive spindle 21. The forcible guide may be implemented, for example, as a spiral recess in drive spindle 21 and a journal of hammer 16 engaging with the recess. Drive spindle 21 is driven by electric motor 7.

Output spindle 9 protrudes out of power tool housing 13. The protruding end forms a tool holder 23. Tool holder 23 has a square cross section. A socket 24 or a similar tool may be mounted on tool holder 23. Socket 24 includes a bushing 25 having a square, hollow cross section, whose dimensions essentially correspond to those of tool holder 23. Socket 24 has a mouth 26 opposite bushing 25 for receiving hexagonal screw 4 or a hexagonal nut.

Impact wrench 1 includes an impact sensor 27 for detecting impacts. Impact sensor 27 is, for example, an acceleration sensor 28 or a microphone. The impacts result in a shock of impact wrench 1 having a characteristic signature. For example, the amplitudes of the detected acceleration or the volume of the detected sounds may be compared with a limiting value.

Another embodiment of impact sensor 27 includes an evaluation of the power consumption of electric motor 7. The power consumption shows a characteristic, brief, abrupt change in power consumption in relation to the impact of hammer 16 onto anvil 17. Impact sensor 27 may, for example, filter the signal of the power consumption with the aid of a high-pass filter and compare it with a limiting value. Instead of or in addition to the power consumption, brief changes in the rotational movement of hammer 16 or electric motor 7 may be detected. For example, rotational speed U of electric motor 7 may be briefly reduced during the impact.

Impact wrench 1 includes an angle sensor 29 for detecting an angular position phi of anvil 17 and of tool holder 23. Angle sensor 29 may detect angular position phi of anvil 17 directly. For example, optically detectable markings, e.g. grooves, may be embossed on anvil 17. Angle sensor 29 is based on an optical sensor system, which detects the markings.

Angle sensor 29 may estimate the progress of angular position phi of tool holder 23. For example, angle sensor 29 estimates angular position phi, based on the rotational movement of drive spindle 21 during the period between two impacts. Hammer 16 and anvil 17 were temporarily out of engagement precisely one time. Anvil 17 does not rotate during the lack of engagement. The next engagement takes place when dogs 18, 19 are rotated back into an engaging position. These positions are typically offset with respect to each other by the angular distance between dogs 18 of hammer 16. Accordingly, anvil 17 has rotated by this angular distance less than hammer 16 during the period between two impacts. The rotational movement of hammer 16 may be directly detected at hammer 16, drive spindle 21 or directly at electric motor 7.

Figure 2:
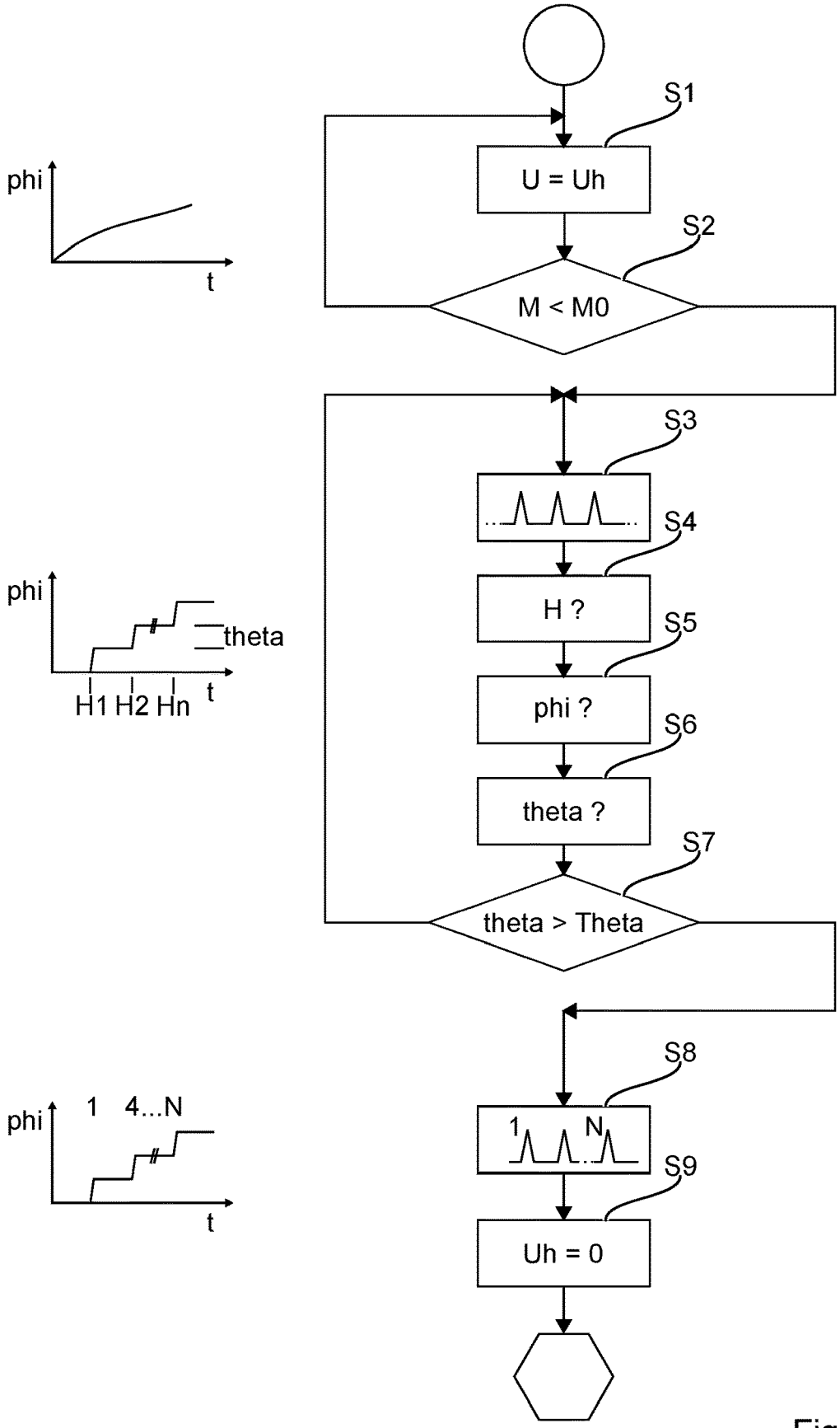
FIG. 2 shows a control method for a first operating mode.
Figure 3:
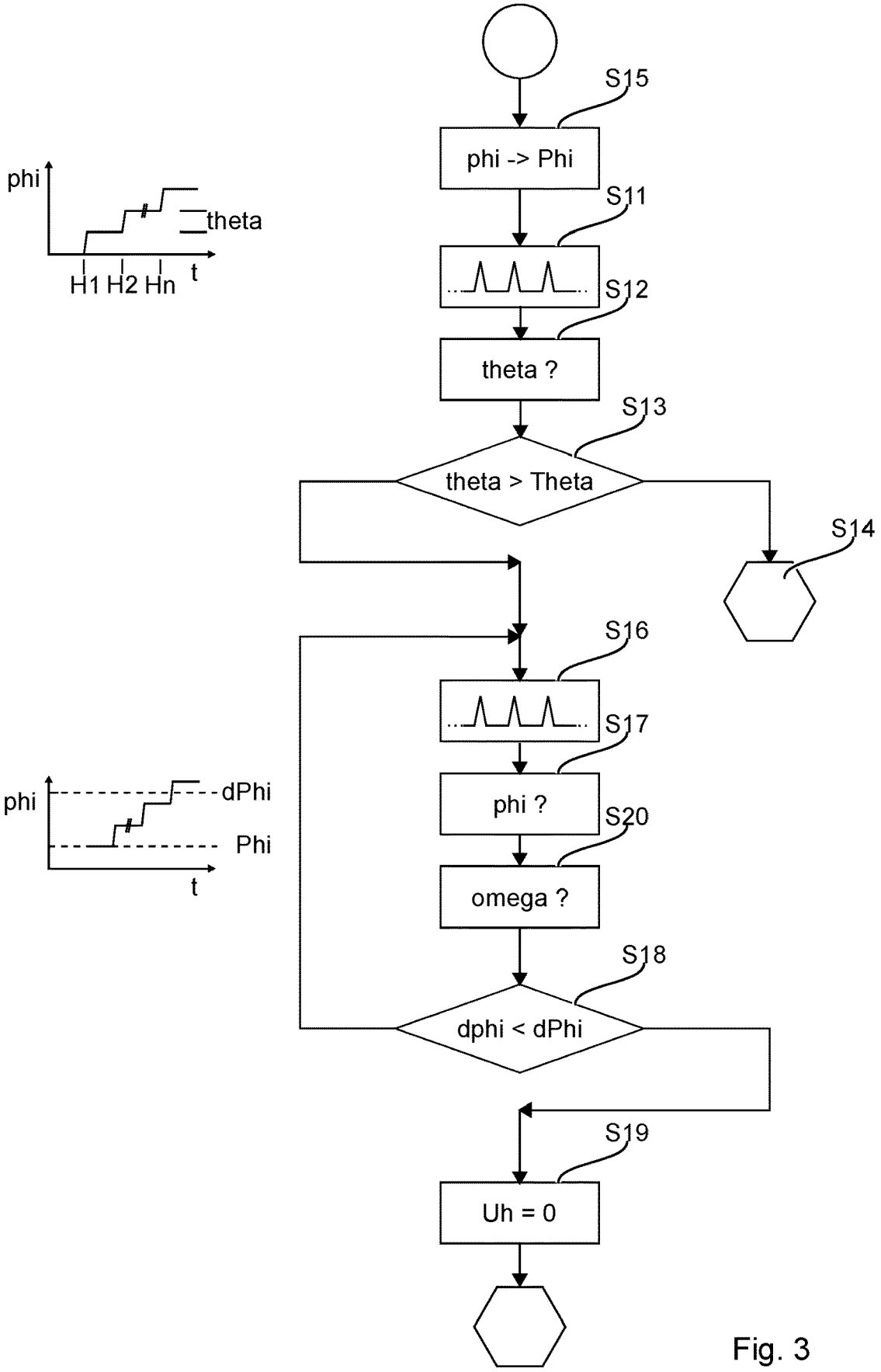
FIG. 3 shows a control method for a second operating mode.

An example of the control method is explained on the basis of the flowchart in FIG. 2. Device controller 30 detects the position of operating mode selector switch 15. Device controller 30 carries out a first operating mode or a second operating mode according to the position of the operating mode selector switch.

The first operating mode may begin with an optional preliminary phase. Screw 4 rotates continuously. Impact wrench 1 rotates tool holder 23 at a continuous rotational speed U, which is equal to rotational speed Uh of hammer 16 (Step S1). Rotational speed U may be predefined by the user via pushbutton 14, or it may be stored in device controller 30 as a predefined variable. Impact wrench 1 may reduce rotational speed Uh of hammer 16 to suppress the striking of the striking mechanism. The reduction of rotational speed Uh may take place up to a minimum value. An angular position phi of tool holder 23 increases continuously. The continuous rotation facilitates a high working speed.

Impact wrench 1 ends the continuous rotation of tool holder 23 as soon as retroactive torque M exceeds a predefined load value MO at tool holder 23 (Step S2).

Impact wrench 1 automatically changes to a striking operation. The changeover is preferably implemented by the mechanical structure of impact wrench 1. In the example of impact wrench 1, load value MO and the incline of path 22 are predefined by the spring force of helical spring 20. For example, load value MO may be varied by a settable pretension of helical spring 20.

Impact wrench 1 causes hammer 16 to repeatedly strike anvil 17 in circumferential direction 31 (Step S3). Angular position phi of tool holder 23 now changes discontinuously, i.e. step by step. Anvil 17 rotates around an individual impact angle theta in circumferential direction 31 due to each individual impact. Anvil 17 idles between impacts.

Individual impact angle theta is dependent on the counter-torque of nut 5. The impact energy is preferably constant. The counter-torque of nut 5 increases as nut 5 continues to be tightened, and individual impact angle theta is therefore reduced. Individual impact angle theta may be reduced uniformly and monotonously. However, abrupt changes in individual impact angle theta may also result. Likewise, a temporary increase in individual impact angle theta is also possible, for example when steel plate 2 relaxes. Correspondingly, the point in time of impact events H1, H2, Hn of an impact is a priori undetermined.

Individual impact angle theta is detected for each individual impact during striking operation. For example, impact sensor 27 detects when or whether an impact takes place (Step S4). Angle sensor 29 continuously detects angular position phi of anvil 17 (Step S5). Device controller 30 ascertains individual impact angle theta of anvil 17 due to each individual impact (Step S6), based on angular position phi before and after the particular impact. Individual impact angle theta is compared with an individual impact setpoint angle Theta (Step S7).

Once individual impact angle theta has dropped below individual impact setpoint angle Theta, the first operating mode changes. In a first specific embodiment, impact wrench 1 ends the first operating mode and deactivates electric motor 7. In a second specific embodiment, a fixed number N of impacts are carried out (Step S8). Number N is in the range between 5 impacts and 20 impacts. The striking with a fixed number N is particularly advantageous if individual impact setpoint angle Theta predefined by screw 4 is below the resolution limit of the available sensors. It has been recognized that, in this case, a fixed number N of impacts is more robust than a priori unknown influences starting at a pretension already reached, e.g. compared to relative rotation angle dphi. Impact wrench 1 subsequently ends first operating mode and deactivates striking mechanism 8, e.g. by switching off electric motor 7 (Step S9).

Individual impact setpoint angle Theta and possibly fixed number N of impacts may be stored in a memory 32 for different fastening elements 4. The user selects fastening element 4 via a control element 33 on impact wrench 1 or an external console 34 communicating with impact wrench 1. Device controller 30 adapts individual impact setpoint angle Theta and possibly fixed number N of impacts for the control method of the first phase according to the selection made by the user.

The second operating mode or second phase may begin by checking the expansion already reached. For example, impact wrench 1 strikes a fewer number of times, e.g. once to three times (Step S11). Impact wrench 1 detects individual impact angle theta (Step S12). The detection of individual impact angle theta may take place as described above. Individual impact angle theta is compared with individual impact setpoint angle Theta (Step S13) If individual impact angle theta does not drop below predefined individual impact setpoint angle Theta, device controller 30 aborts the second operating mode and issues a warning to the user (Step S14). The user is preferably prompted to tighten the screws according to the first operating mode. If individual impact setpoint angle Theta is not reached, the actual second operating mode begins.

At the beginning of the second phase, instantaneous angular position phi of anvil 17 is detected and stored as initial position Phi (Step S15). Initial position Phi is preferably detected before the check to also detect the rotation carried out by the check for the subsequent method.

Impact wrench 1 strikes anvil 17 (Step S16). Angle sensor 29 detects instantaneous angular position phi of anvil 17 (Step S17). Instantaneous angular position phi is continuously compared with initial position Phi. Instantaneous relative rotation angle dphi is determined from instantaneous angular position phi, based on initial position Phi. For example, relative rotation angle dphi is simply the difference between instantaneous angular position phi of anvil 17 and initial position Phi. Instantaneous relative rotation angle dphi is compared with standard angle dPhi. Once it is detected that instantaneous relative rotation angle dphi is larger than standard angle dPhi (Step S18), device controller 30 stops striking mechanism 8, e.g. by deactivating electric motor 7 (Step S19). Screw 4 is now tightened to the final expansion.

During the first phase, egomotions of impact wrench 1, in particular a rotational movement around working axis 10, may be disregarded in a good approximation. The estimate of individual impact angle theta is sufficiently independent of the typical, usually slow egomotions which occur. During the second phase, the egomotion may have an influence on the expansion. The relative expansion of screw 4 to be achieved with respect to nut 5 is equal to instantaneous angular position phi of anvil 17 with respect to power tool housing 13 only in an idling impact wrench 1. Impact wrench 1 advantageously detects rotational movements of its power tool housing 13 with respect to space during the second phase. For example, impact wrench 1 includes a rotational movement sensor 35 for determining an angular velocity around working axis 10, based on the Coriolis force, or an acceleration sensor for determining rotational accelerations around working axis 10. Device controller 30 ascertains an angle omega, based on the rotational movement, by which impact wrench 1 has rotated around working axis 10. Instantaneous angular position phi of anvil 17 is corrected by angle omega (Step S20).

Standard angle dPhi may be stored in a memory 32 for different fastening elements 4. The user selects fastening element 4 via a control element 33 on impact wrench 1 or an external console 34 communicating with impact wrench 1. According to the selection by the user, device controller 30 adapts standard angle dPhi for the control method of the second phase.

External console 34 has an interface 36 for wireless communication, which is able to communicate with a corresponding interface 37 of impact wrench 1. External console 34 includes, for example, database 38 containing the parameters, such as individual impact setpoint angle Theta and standard angle dPhi for different fastening means, screws, etc. External console 34 may be implemented, for example by a software application on a conventional mobile device, e.g. a smart phone.

The tightening of screw 4 with the aid of the first operating mode and the second operating mode is preferably automatically logged for each screw 4. For example, the log records the point in time at which a screw 4 was tightened with the aid of the first operating mode and at which screw 4 was tightened with the aid of the second operating mode. For example, it may be determined therefrom whether all screws are first tightened on a steel beam 3 with the aid of the first operating mode before the first of the screws is tightened to the final expansion with the aid of the second operating mode, as desired. Impact wrench 1 may assign the log to the individual screws, for example based on their position in space. A tracking device 39 detects the position of impact wrench 1 in space, which is essentially equal to the position of screw 4 in space. Tracking device 39 may communicate with a corresponding interface 37 of device controller 30 via a wireless interface 40. Alternatively, tracking device 39 transmits the position to external console 34. A database 38 for recording the log may be provided in impact wrench 1 or in console 34.

What is claimed is:

1. A control method for a handheld impact wrench for fastening steel components with the aid of screw connections, the impact wrench including a handle, an electric motor, a hammer driven by the electric motor, an anvil for absorbing impacts of the hammer acting in a circumferential direction, a tool holder situated on the anvil and an operating mode selector switch, the control method including the steps:

carrying out a first operating mode when the operating mode selector switch is in a first position, first impacts of the hammer being carried out on the anvil during the first operating mode, an event of an impact of the first impacts of the hammer onto the anvil being detected with the aid of an impact sensor;

an angular position of the anvil being detected with the aid of an angle sensor, an individual impact angle of the anvil being estimated due to the last detected impact, based on the angular position of the anvil before a last detected impact of the first impacts and the angular position of the anvil after the last detected impact;

the individual impact angle being compared with an individual impact setpoint angle;

the first operating mode being ended when the individual impact angle drops below an individual impact setpoint angle; and carrying out a second operating mode when the operating mode selector switch is in a second position, the angular position of the anvil being detected with the aid of the angle sensor as the initial position during the second mode prior to second impacts occurring during the second operating mode;

carrying out the second impacts of the hammer onto the anvil, a relative rotation angle of the anvil with respect to the initial position being determined during the second impacts; and the second operating mode being ended when the relative rotation angle exceeds a standard angle.

2. The control method as recited in claim 1 wherein the event of an impact during the first or second operating mode is detected with the aid of an acceleration sensor or a microphone.

3. The control method as recited in claim 1 wherein changes in a power consumption of the electric motor or in a rotational speed of the electric motor are detected, and a point in time at which a change exceeding an impact threshold value occurs is assigned to the event of an impact.

4. The control method as recited in claim 1 wherein a rotational movement of the hammer and a number of the impacts are detected, and the angular position of the anvil is determined based on a rotational movement of the hammer and the number of impacts.

5. The control method as recited in claim 4 wherein a rotational movement of the electric motor is determined to detect the rotational movement of the hammer.

6. The control method as recited in claim 4 wherein a rotational movement of the handle is detected with the aid of a rotational movement sensor, and the relative rotation angle is determined, based on the angular position of the anvil and the rotational movement of the handle.

7. The control method as recited in claim 1 wherein a predefined number of third impacts is carried out with the aid of the hammer directly subsequent to the first impacts.

8. The control method as recited in claim 1 wherein the second operating mode carries out at least one first impact prior to carrying out the second impacts, determines the individual impact angle with respect to the first impact and compares the individual impact angle with the individual impact setpoint angle, the second operating mode being aborted if the individual impact angle exceeds the individual impact setpoint angle.

9. The control method as recited in claim 1 wherein the first operating mode and the second operating mode are logged individually for each screw of the screw connections.

10. The control method as recited in claim 1 wherein the first operating mode include a preliminary phase where the impact wrench rotates the tool holder at a continuous rotational speed prior to the event of an impact.

11. The control method as recited in claim 10 wherein the continuous rotational speed is predefined by a user via a pushbutton.

12. The control method as recited in claim 10 wherein the continuous rotational speed ends when a retroactive torque exceeds a predefined load value at the tool holder.

13. The control method as recited in claim 10 wherein the predefined load value is variable by a settable pretension of a helical spring.

14. The control method as recited in claim 1 wherein at a beginning of the second operating mode, an instantaneous angular position of the anvil is detected.

* * * * *